US005945020A

United States Patent [19]

Kuroda et al.

[11] Patent Number: 5,945,020

[45] Date of Patent: Aug. 31, 1999

[54] LAMINATED HEATING STRUCTURE

[75] Inventors: Rikio Kuroda, Sagamihara; Motomi Nogiwa, Zushi; Yoshiharu Ogawa; Kazunori Hosomi, both of Nagoya, all of Japan

[73] Assignee: Nippon Petrochemicals Co., Ltd., Tokyo, Japan

[21] Appl. No.: 08/894,469

[22] PCT Filed: Dec. 25, 1995

[86] PCT No.: PCT/JP95/02667

§ 371 Date: Dec. 2, 1997

§ 102(e) Date: Dec. 2, 1997

[87] PCT Pub. No.: WO97/23810

PCT Pub. Date: Jul. 3, 1997

[51] Int. Cl.[6] ..... H05B 3/16

[52] U.S. Cl. ..... 219/543; 219/549

[58] Field of Search ..... 219/543, 549, 219/469, 470, 471; 338/306, 307, 308, 309; 492/46

[56] References Cited

U.S. PATENT DOCUMENTS

| | | | |
|---|---|---|---|
| 3,878,361 | 4/1975 | Levin et al. | 219/522 |
| 5,234,524 | 8/1993 | Ozuet et al. | 156/327 |
| 5,517,751 | 5/1996 | Brosset et al. | 29/830 |

FOREIGN PATENT DOCUMENTS

| | | |
|---|---|---|
| 2-157882 | 6/1990 | Japan . |
| 4-135750 | 5/1992 | Japan . |
| 4-147597 | 5/1992 | Japan . |
| 5-346744 | 12/1993 | Japan . |
| 7-064425 | 3/1995 | Japan . |

*Primary Examiner*—Teresa Walberg
*Assistant Examiner*—Vinod D Patel
*Attorney, Agent, or Firm*—Fisher, Christen & Sabol

[57] ABSTRACT

There is provided a laminated heating structure comprising a molding layer (A) made of a thermotropic liquid crystal polymer, a conductive layer (B) for heating a protective coating layer (C) by applying an electric current therethrough, and the protective coating layer (C), provided that the layers (A), (B) and (C) are laminated in this order, and an inexpensive laminated heating structure excellent in heat resistance, dimensional accuracy and mechanical strength, reduced in electric power consumption, and shortened in build-up time.

12 Claims, 1 Drawing Sheet

LAMINATED HEATING STRUCTURE

TECHNICAL FIELD

The present invention relates to a laminated heating structure useful as a heating plate, a heating roll or the like for use in a copying machine or the like, and particularly to a laminated heating structure excellent in heat resistance, dimensional accuracy, mechanical strength, etc.

BACKGROUND ART

Many heating means are used for ink or toner fixation or for photosensitization in a copying machine and the like. For example, many heating means are used in a long substrate such as a toner fuser of a copying machine or a drying roll of an automatic developing machine. Structures such as a heating plate or a heating roll are adopted as such heating means. Further, such heating structures are usually in the form of a laminated structure.

Since heating structures such as a heating plate or a heating roll are required to have not only a high heat resistance as heating elements but also a dimensional accuracy and a surface smoothness, the conventionally used ones are in the form of a structure comprising a ceramic or like base having a high heat resistance and a good dimensional accuracy and a metallic resistor laminated on the surface of the base. However, a ceramic base is very expensive because it is produced by cutting a sintered ceramic, and involves a demerit of difficulty in handling because it is liable to crack.

Moreover, such a structure involves not only the problem of necessity of a large electric power because it has a comparatively high thermal conductivity and is hence liable to dissipate heat, but also the problem of long heating time (build-up time) required till it reaches a predetermined temperature because it has a comparatively large heat capacity.

An object of the present invention is to solve the foregoing problems of the prior art to thereby provide an inexpensive laminated heating structure excellent in heat resistance, dimensional accuracy and mechanical strength, reduced in electric power consumption, and shortened in build-up time.

DISCLOSURE OF THE INVENTION

Figure 1:
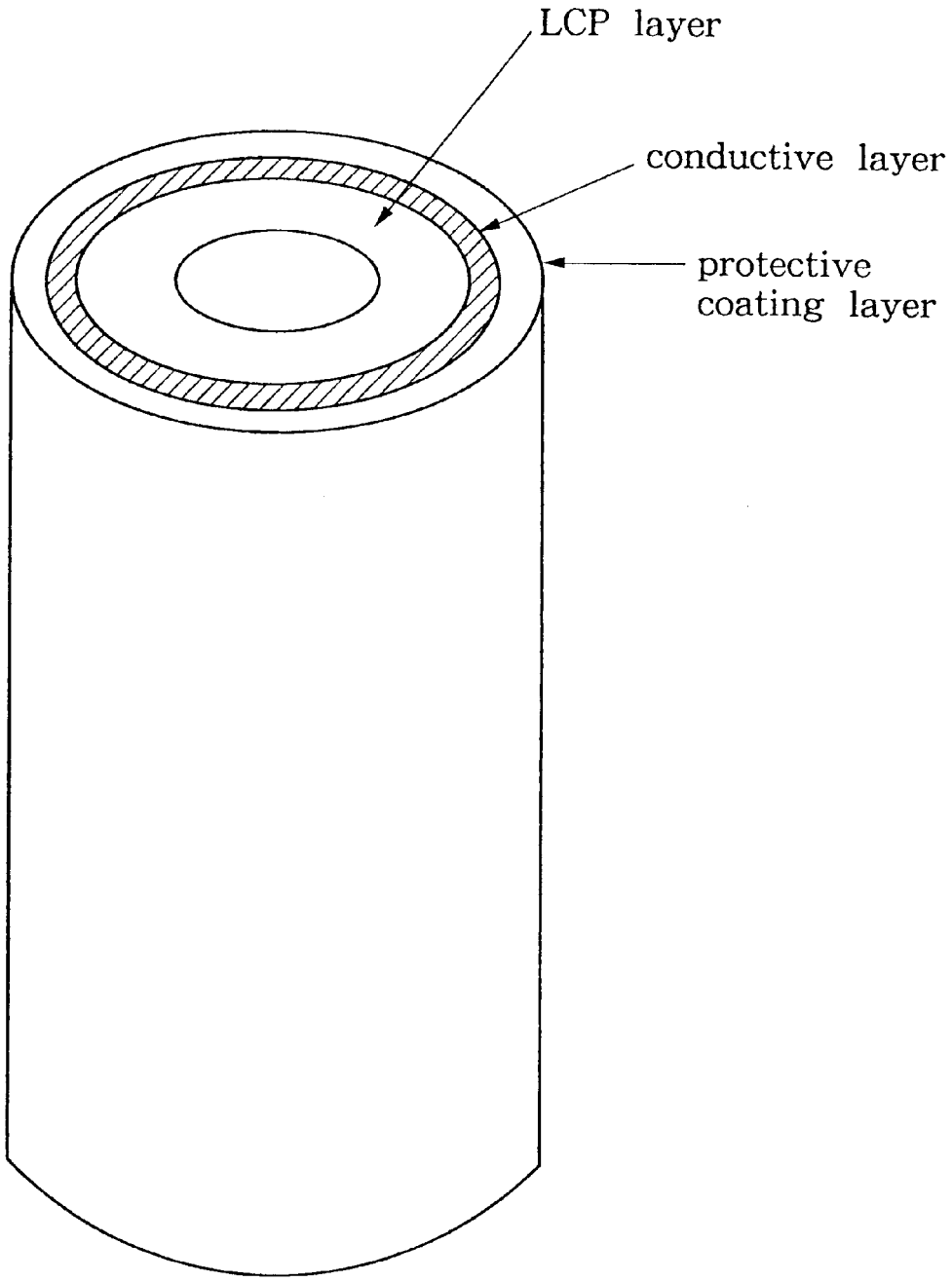
FIG. 1: shows a cylindrically shaped laminated heating structure according to the invention.

As a result of extensive investigations on the foregoing problems of the ceramic heating structure, the present inventors have completed the present invention according to which the foregoing problems can be solved.

Specifically, the present invention is directed to a laminated heating structure comprising a molding layer (A) made of a thermotropic liquid crystal polymer, a conductive layer (B) for heating a protective coating layer (C) by applying an electric current therethrough, and the protective coating layer (C), provided that the layers (A), (B) and (C) are laminated in this order as shown in FIG. 1.

The present invention will now be described in more detail.

The laminated heating structure of the present invention indispensably comprises the foregoing three layers (A), (B) and (C), but the process for producing the same is not particularly limited in so far as the resulting structure is a laminated structure having the foregoing constitution.

However, the laminated structure having the constitution of the present invention can be produced, for example, by using a thermotropic liquid crystal polymer to produce a columnar, laminar or like molding by an arbitrary molding method such as injection or extrusion, and then laminating the layers (B) and (C) thereon, for example, by coating or laminating.

The shape of the laminated heating structure of the present invention may be any of cylindrical and laminar ones for attaining the purpose of the present invention.

The molding layer (A) as the base is made of a thermotropic liquid crystal polymer excellent in heat resistance and dimensional accuracy, preferably a thermotropic liquid crystal polyester resin.

The thermotropic liquid crystal polymer so called in the present invention is a meltable thermoplastic polymer capable of exhibiting an optical anisotropy in a molten state. The polymer capable of exhibiting an optical anisotropy in a molten state has such a property that the molecular chains of the polymer take a regular parallel arrangement in a molten state. This property of the optically anisotropic molten phase can be confirmed by the customary polarization test method wherein crossed polarizers are used.

Examples of the above-mentioned liquid crystal polymer include liquid crystal polyesters, liquid crystal polycarbonates, and liquid crystal polyester imides, specific examples of which include (wholly) aromatic polyesters, polyester amides, polyamide imides, polyester carbonates, and polyazomethines.

The thermotropic liquid crystal polymer, which generally has a slender and flat molecular structure, is highly rigid along the long chain of the molecule, which has a plurality of chain-extending bonds either in the coaxial relation or in the parallel relation.

The thermotropic liquid crystal polymers to be used in this invention include a polymer comprising a segment of a polymer capable of forming an anisotropic molten phase as part of one polymer chain thereof and a segment of a polymer incapable of forming an anisotropic molten phase as the rest of the polymer chain, and also a composite of a plurality of thermotropic liquid crystal polymers.

Representative examples of the monomers usable for the formation of the thermotropic liquid crystal polymer include:

(a) at least one aromatic dicarboxylic acid compound, (b) at least one aromatic hydroxy carboxylic acid compound, (c) at least one aromatic diol compound, (d) at least one of an aromatic dithiol ($d_1$), an aromatic thiophenol ($d_2$), and an aromatic thiol carboxylic acid compound ($d_3$), and (e) at least one of an aromatic hydroxyamine compound and an aromatic diamine compound.

They may sometimes be used alone, but may frequently be used in a combination of monomers (a) and (c); (a) and (d); (a), (b) and (c); (a), (b) and (e); (a), (b), (c) and (e); or the like.

Examples of the aromatic dicarboxylic acid compound (a) include aromatic dicarboxylic acids such as terephthalic acid, 4,4'-diphenyldicarboxylic acid, 4,4'-triphenyldicarboxylic acid, 2,6-naphthalenedicarboxylic acid, 1,4-naphthalenedicarboxylic acid, 2,7-naphthalenedicarboxylic acid, diphenyl ether-4,4'-dicarboxylic acid, diphenoxyethane-4,4'-dicarboxylic acid, diphenoxybutane-4,4'-dicarboxylic acid, diphenylethane-4,4'-dicarboxylic acid, isophthalic acid, diphenyl ether-3,3'- dicarboxylic acid, diphenoxyethane-3,3'-dicarboxylic acid, diphenylethane-3,3'-dicarboxylic acid, and 1,6-naphthalenedicarboxylic acid; and alkyl-, alkoxy- and halogen-substituted derivatives of the above-mentioned aromatic dicarboxylic acids, such as chloroterephthalic acid, dichloroterephthalic acid, bromoterephthalic acid, methylterephthalic acid, dimethylterephthalic acid, ethylterephthalic acid, methoxyterephthalic acid, and ethoxyterephthalic acid.

Examples of the aromatic hydroxy carboxylic acid compound (b) include aromatic hydroxy carboxylic acids such as 4-hydroxybenzoic acid, 3-hydroxybenzoic acid, 6-hydroxy-2-naphthoic acid, and 6-hydroxy-1-naphthoic acid; and alkyl-, alkoxy- and halogen-substituted derivatives of the aromatic hydroxy carboxylic acids, such as 3-methyl-4-hydroxybenzoic acid, 3,5-dimethyl-4-hydroxybenzoic acid, 6-hydroxy-5-methyl-2-naphthoic acid, 6-hydroxy-5-methoxy-2-naphthoic acid, 2-chloro-4-hydroxybenzoic acid, 3-chloro-4-hydroxybenzoic acid, 2,3-dichloro-4-hydroxybenzoic acid, 3,5-dichloro-4-hydroxybenzoic acid, 2,5-dichloro-4-hydroxybenzoic acid, 3-bromo-4-hydroxybenzoic acid, 6-hydroxy-5-chloro-2-naphthoic acid, 6-hydroxy-7-chloro-2-naphthoic acid, and 6-hydroxy-5,7-dichloro-2-naphthoic acid.

Examples of the aromatic diol compound (c) include aromatic diols such as 4,4'-dihydroxydiphenyl, 3,3'-dihydroxydiphenyl, 4,4'-dihydroxytriphenyl, hydroquinone, resorcinol, 2,6-naphthalenediol, 4,4'-dihydroxydiphenyl ether, bis(4-hydroxyphenoxy)ethane, 3,3'-dihydroxydiphenyl ether, 1,6-naphthalenediol, 2,2-bis(4-hydroxyphenyl)propane, and bis(4-hydroxyphenyl) methane; and alkyl-, alkoxy- and halogen-substituted derivatives of the aromatic diols, such as chlorohydroquinone, methylhydroquinone, t-butylhydroquinone, phenylhydroquinone, methoxyhydroquinone, phenoxyhydroquinone, 4-chlororesorcinol, and 4-methylresorcinol.

Examples of the aromatic dithiol ($d_1$) include benzene-1,4-dithiol, benzene-1,3-dithiol, 2,6-naphthalene-dithiol, and 2,7-naphthalene-dithiol.

Examples of the aromatic thiophenol ($d_2$) include 4-mercaptophenol, 3-mercaptophenol, and 6-mercaptophenol.

Examples of the aromatic thiol carboxylic acid ($d_3$) include 4-mercaptobenzoic acid, 3-mercaptobenzoic acid, 6-mercapto-2-naphthoic acid, and 7-mercapto-2-naphthoic acid.

Examples of the aromatic hydroxyamine compound and the aromatic diamine compound (e) include 4-aminophenol, N-methyl-4-aminophenol, 1,4-phenylenediamine, N-methyl-1,4-phenylenediamine, N,N'-dimethyl-1,4-phenylenediamine, 3-aminophenol, 3-methyl-4-aminophenol, 2-chloro-4-aminophenol, 4-amino-1-naphthol, 4-amino-4'-hydroxydiphenyl, 4-amino-4'-hydroxydiphenyl ether, 4-amino-4'-hydroxydiphenylmethane, 4-amino-4'-hydroxydiphenyl sulfide, 4,4'-diaminodiphenyl sulfide (thiodianiline), 4,4'-diaminodiphenyl sulfone, 2,5-diaminotoluene, 4,4'-ethylenedianiline, 4,4'-diaminodiphenoxyethane, 4,4'-diaminodiphenylmethane (methylenedianiline), and 4,4'-diaminodiphenyl ether (oxydianiline).

The thermotropic liquid crystal polymer to be used in the presnt invention is prepared from monomer(s) as mentioned above by a variety of esterification methods such as melt acidolysis or slurry polymerization, or the like methods.

The molecular weight of the thermotropic liquid crystal polyester that may favorably be used in the present invention may be about 2,000 to 200,000, preferably 4,000 to 100,000. The measurement of the molecular weight may be done, for example, either through determination of the terminal groups of a compressed film thereof according to infrared spectroscopy, or by gas permeation chromatography (GPC), which is a general-purpose measurement method involving the formation of a solution.

Among thermotropic liquid crystal polymers obtained from these monomers, an aromatic polyester as a polymer or copolymer comprising monomer units of the following general formula (1) as the indispensable component is preferred, and an aromatic polyester comprising at least 5 mol % of the above-mentioned monomer units is especially preferred.

(1)

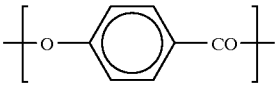

A particularly preferable aromatic polyester to be used in the present invention is a polyester of the following general formula (2) having recurring units of structures respectively derived from three kinds of compounds, p-hydroxybenzoic acid, phthalic acid and biphenol. The recurring units of the structure derived from biphenol in the polyester of this general formula (2) may be either partly or wholly substituted by recurring units derived from dihydroxybenzene to form a polyester. Another particularly preferable aromatic polyester is a polyester of the following general formula (3) having recurring units of structures respectively derived from two kinds of compounds, p-hydroxybenzoic acid and hydroxynaphthalenecarboxylic acid.

(2)

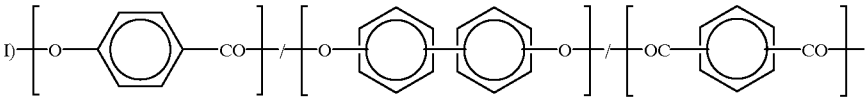

-continued (3)

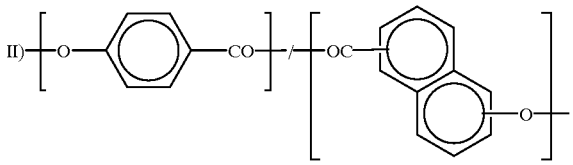

Thermotropic liquid crystal polymers usable in the present invention may be used either alone or in mixture of at least two thereof.

The thermotropic liquid crystal polymer(s) may further be used either alone or in combination with other non-liquid-crystalline thermoplastic synthetic resin(s).

The thermotropic liquid crystal polymer may be blended with a variety of additives if necessary. An inorganic filler is particularly effective in further improving the mechanical strength, heat resistance, dimensional stability, etc., of the liquid crystal polymer. Further, a suitable inorganic filler, if blended, is effective in decreasing the temperature nonuniformity of the laminated heating structure since the thermal conductivity of the layer (A) can be enhanced.

Specific examples of the inorganic filler to be blended include glass fibers, talc, mica, calcium carbonate, clay, calcium sulfate, magnesium hydroxide, silica, alumina, barium sulfate, titanium oxide, zinc oxide, iron oxide, graphite, glass flakes, glass beads, various metal powders, various metal fibers, and various whiskers. The amount of the inorganic filler to be blended in the liquid crystal polymer may be, for example, about 5 to 90 wt. % though it is not particularly limited thereto. Other additives include an antioxidizing agent, a heat stabilizer, an ultraviolet absorber, a light stabilizer, a pigment, a dye, a plasticizer, a lubricant, a nucleating agent, an antistatic agent, and a flame retardant.

The shape of the structure constituting the molding layer (A) of the laminated heating structure of the present invention, which is not particularly limited, may be a variety of shapes like a cylinder, a round column, a square column, or a plate (laminar), but is preferably a cylinder or a plate (laminar) as a heating element or the like for use in a copying machine.

The structure constituting the molding layer (A) having the foregoing shape is formed by the customary method for molding a thermoplastic synthetic resin, such as extrusion, injection, or compression. Among them, injection molding is recommended since it has a high productivity and provides a good dimensional accuracy.

The thickness of the molding layer (A), though not particularly limited, must be somewhat large in order to impart a mechanical strength to the laminated heating structure, and may be, for example, in the range of 1 to 20 mm.

The conductive layer (B) of the laminated heating structure of the present invention is not particularly limited in so far as it is a conductive layer capable of heating the protective coating layer (C) to a temperature of 30 to 400° C. by applying an electric currenty therethrough. In general, the conductive layer has a resistivity of about $10^{-5}$ to $10^{-3}$ Ωcm and a thickness of 0.01 to 100 μm. The conductive layer may usually be made of a conductive resin or a thin metal film. In the case of a conductive layer made of a conductive resin, the conductive resin may be applied on the outer peripheral surface of the molding layer (A) by screen printing to form the conductive layer. On the other hand, a conductive layer made of a thin metal layer can be formed, for example, according to a method wherein a conductive thin metal film-forming material such as NiCr or $Ta_2N$ is deposited on the outer peripheral surface of the structure, for example, by vacuum thin film formation methods such as vacuum deposition or sputtering.

The conductive resin is prepared by kneading a mixture of a polyimide, modified epoxy resin or the like excellent in heat resistance with a conductive silver or carbon powder and a solvent for adjusting the adaptability to printing thereof. The resistivity of the conductive resin is adjusted for attaining a desired resistance by varying the mixing ratio of the conductive powder to the resin, and the particle size and/or shape of the conductive powder. The resistivity is preferably in the range of about $5\times10^{-5}$ to $5\times10^{-3}$ Ωcm.

The conductive resin can be applied on the surface of the layer (A) by the customary screen printing method in a case where the layer (A) is a plate or a square column. In a case where the layer (A) is a cylinder or a round column, for example, the application by printing is conducted with a rotary printing press as a kind of screen printing. The printed conductive resin is usually preheated at a temperature of 100 to 150° C., and then heat-cured at a temperature of about 250 to 300° C. The thickness of the conductive layer (B) is desirably 5 to 30 μm.

A thin metal film of NiCr or the like is formed on the outer peripheral surface of the layer (A) by the vacuum deposition, sputtering or like methods. In this case, the resistivity is usually about $2.5\times10^{-4}$ to $1\times10^{-4}$ Ωcm. A thin metal film of $Ta_2N$ is formed by reactive sputtering wherein glow discharge is brought about in a low-vacuum mixed gas of Ar and $N_2$ while using Ta as a target. In this case, the resistivity is usually about $1.5\times10^{-4}$ to $3\times10^{-4}$ Ωcm. In a case where the layer (A) is a square column or a cylinder, the structure of the layer (A) is revolved during film deposition to effect uniform film deposition. The thickness of the thin metal film is about 0.03 to 1 μm according to either of the foregoing methods.

In the laminated heating structure of the present invention, the conductive layer (B) is not necessarily required to have a sufficient adhesive force to the layer (A). For example, mechanical bonding means may be used for mutual bonding of the two layers. However, bonding is preferably done with a sufficient adhesive force in order to prevent peeling, exfoliation and the like during service. In view of this, it is desired to select a conductive resin having a good adhesion to the layer (A). When the adhesion is weak, irradiating the surface of the layer (A) with ultraviolet rays is also effective in improving the adhesion. When the adhesion of the thin metal film to the layer (A) is insufficient, exposing the layer (A) before the formation of the thin metal film to a plasma, etching the surface with a strong acid, an alkali solution or an organic solvent, or forming thereon a Cr film having a good adhesion thereto in a thickness of 0.005 to 0.5 μm is effective in improving the adhesion.

The electric resistance of the conductive layer (B) of the laminated heating structure of the present invention is adjusted in such a way that the surface temperature of this structure, i.e., the temperature of the protective coating layer (C), can be raised to 30 to 400° C. When this temperature is lower than 30° C., the laminated structure cannot function as a heating element. When this temperature exceeds 400° C., the layer (A) is thermally so deformed as to be unfit for service. In order to adjust this temperature to a desired temperature falling within the foregoing temperature range, controlling the electric resistance, cross-sectional area and length of the layer (B), the voltage applied thereto, etc. will suffice. Such temperature control is usually done by applying a voltage while measuring the surface temperature of the laminated heating structure with a temperature-detecting element such as a thermistor, either brought into contact with the laminated heating structure or embedded in the layer (A).

The conductive layer (B) of the laminated heating structure of the present invention may be laminated either all over the surface of the layer (A) or partly thereover in an appropriate form such as a striped form or a latticed form, depending on the necessary extent of heating and the like. In the latter case, the surface of the layer (C) is brought into direct contact with the layer (A) where the layer (B) is not laminated on the layer (A).

In the laminated heating structure of the present invention, the protective coating layer (C) is laminated for the purpose of protecting the layer (B) or the layer (A) because the surface of the laminated structure as a heating element may sometimes come into contact with other material, part, etc. during service thereof as a roll or the like to undergo contamination, damage, etc. Thus, the material of the layer (C) is preferably a material having good abrasion resistance, sliding properties, lubricating properties, etc.

Examples of such a material suitable for the layer (C) include fluoro-homopolymer and copolymer resins such as a polytetrafluoroethylene resin (PTFE), a perfluoroalkoxy resin (PFA), a tetrafluoroethylene/hexafluoropropylene copolymer resin (FEP), a tetrafluoroethylene/ethylene copolymer resin (ETFE), and a polyvinylidene fluoride resin (PVdF); fluororubbers such as hexafluoropropylene copolymer rubbers; silicone resins; silicone rubbers; and heat-resistant engineering resins such as polyimides, polyamide imides, polyether imides, polyphenylene sulfides, and thermotropic liquid crystal polyesters. However, a protective film made of a silicone resin coating material is excluded. Among them, fluororesins are especially preferred since they are excellent in abrasion resistance, sliding properties, lubricating properties, etc.

The material of the protective coating layer may also be blended with a variety of inorganic fillers, antioxidizing agents, heat stabilizers, ultraviolet absorbers, light stabilizers, pigments, dyes, plasticizers, lubricants, nucleating agents, antistatic agents, flame retardants and/or the like if necessary. Although the amount of such a variety of fillers to be blended in the protective coating layer (C) is not particularly limited, it may be, for example, about 1 to 90 wt. %.

In the laminated heating structure of the present invention, the protective coating layer (C) is laminated by arbitrary methods, examples of which include a method wherein the above-mentioned material is first formed into a film or a sheet by extrusion, casting, skiving or like method, followed by the sticking of the film or sheet to effect lamination, and a method wherein a tube is formed from the material by extrusion or the like, and then heat-shrunk after covering therewith to effect coating.

Other methods include methods wherein the material is used in the form of a coating material or an ink, for example, a method wherein either a solution prepared by dissolving the material in a solvent or a suspension prepared by dispersing a powder of the material in a solvent is applied on the layers (A) and (B), and then dried by heating or molten to form a film, and a method wherein a powder of the material is applied by electrostatic coating or the like, and then molten by heating to form a film.

In the laminated heating structure of the present invention, the protective coating layer (C) may be laminated all across the whole surface of the heating element or only where protection therewith is particularly necessary.

Although the thickness of the protective coating layer (C) of the laminated heating structure of the present invention is not particularly limited, it is preferably at least 1 $\mu$m, further preferably at least 5 $\mu$m, in order to satisfy the function of the protective coating, while the upper limit thereof is usually at most 50 $\mu$m.

EXAMPLES

Now, the present invention will be detailed by referring to the following Examples.

Example 1

A cylindrical molding having an outer diameter of 10 mm, a wall thickness of 1 mm and a length of 300 mm was produced by injection molding, a composition composed of 70 parts by weight of a thermotropic liquid crystal polyester (a powder of a quaternary copolyester synthesized from phthalic acid, isophthalic acid, 4-hydroxybenzoic acid and 4,4-dihydroxydiphenyl, and exhibiting an optical anisotropy in a molten state at a temperature of 340° C. or above when observed using a polarizing microscope having a hot stage mounted therein) as a liquid crystal polymer and 30 parts by weight of glass fibers as the filler.

A conductive resin prepared by dispersing a silver powder in a polyimide resin and adjusted to a resistivity of $2.5\times10^{-3}$ Ωcm was applied on the surface of this molding by screen printing with a rotary printing press to form a conductive film of 10 $\mu$m in thickness, which was then preheated at 100° C. and heat-cured at 300° C. for 1.5 hours. The resistance of the resulting cylindrical structure between both ends thereof was measured to be about 20Ω.

The electrode leads on both ends of the structure were then masked, followed by the application of a Teflon resin by spraying. The resulting resin film was then cured at 280° C. to form a protective coating layer of 10 $\mu$m in thickness.

When an electric power of 400 W was applied between the electrodes on both ends of this laminated structure, only eight seconds was required until the temperature of the structure was raised to 180° C. On the other hand, when an electric power of 35 W was applied to examine a stationary temperature profile after five minutes, the temperature of a 220 mm-range middle portion of the structure was within the range of 190 to 200° C. This is a performance sufficient to make the structure usable, for example, as a heating roll in a copying machine.

Example 2

The same polyester composition as used in Example 1 as the thermotropic liquid crystal polyester was used to form a plate (laminar shape) having a width of 10 mm, a wall thickness of 1 mm and a length of 300 mm by injection molding.

A thin film of NiCr (Ni:Cr=80:20) was formed on the surface of this plate using magnetron sputtering equipment. Sputtering was effected in an Ar gas under the conditions involving a pressure of 0.2 Pa, an applied electric power of 1.5 KW and a sputtering time of 10 minutes to form a thin film of 0.15 $\mu$m in thickness, on which a protective coating layer was then formed in the same manner as in Example 1 to form a laminated structure.

When an electric power of 400 W was applied between the electrodes on both ends of this laminated structure, only eight seconds was required until the temperature of the structure was raised to 180° C. On the other hand, when an electric power of 35 W was applied to examine a stationary temperature profile after five minutes, the temperature of a 220 mm-range middle portion of the structure was within the range of 190 to 200° C. This is a performance sufficient to make the structure usable, for example, as a heating roll in a copying machine.

INDUSTRIAL APPLICABILITY

Since the laminated heating structure of this invention comprises a base (a molding layer) made of a liquid crystal polymer, it is excellent in heat resistance, mechanical strength, dimensional stability, etc., and inexpensive. Further, since it has a comparatively small heat conductivity, the electric power consumption thereof is small with a short build-up time. A conductive layer (B) laminated on the base can be adjusted in electric resistance, thickness, lamination pattern, etc. to facilitate the temperature control with little temperature nonuniformity. Since a protective coating layer (C) is laminated on the conducting layer, the conductive layer (B) is not damaged even when brought into or slidden in contact with other material or part, whereby the structure can function as a heating element for a long period of time.

Accordingly, the laminated heating structure of the present invention can be used as a toner fuser (fixing heater) of a copying machine, a drying roll in an automatic developing machine, etc.

What is claimed is:

1. A laminated heating structure comprising a molding layer (A) made of a thermotropic liquid crystal polymer, a conductive layer (B) for heating a protective coating layer (C) by applying an electric current therethrough, and the protective coating layer (C), provided that the layers (A), (B) and (C) are laminated in this order.

2. A laminated heating structure according to claim 1, wherein said laminated structure is a cylindrical shape.

3. A laminated heating structure according to claim 1, wherein said laminated structure is a laminar shape.

4. A laminated heating structure according to claim 1, wherein said protective coating layer (C) is made of a fluororesin.

5. A laminated heating structure according to claim 2, wherein said protective coating layer (C) is made of a fluororesin.

6. A laminated heating structure according to claim 3, wherein said protective coating layer (C) is made of a fluororesin.

7. A laminated heating structure according to claim 1, wherein said thermotropic liquid crystal polymer is an aromatic polyester comprising at least 5 mol % of monomer units represented by the formula (1):

(1)

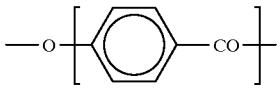

8. A laminated heating structure according to claim 1, wherein said molding layer (A) further comprises at least one inorganic filler selected from the group consisting of glass fibers, talc, mica, calcium carbonate, clay, calcium sulfate, magnesium hydroxide, silica, alumina, barium sulfate, titanium oxide, zinc oxide, iron oxide, graphite, glass flakes, glass beads, metal powders, metal fibers and whiskers.

9. A laminated heating structure according to claim 8, wherein the amount of said inorganic filler in said molding layer (A) is from about 5% to about 90% by weight.

10. A laminated heating structure according to claim 1, wherein said molding layer (A) further comprises at least one additive selected from the group consisting of an antioxidizing agent, a heat stabilizer, an ultraviolet absorber, a light stabilizer, a pigment, a dye, a plasticizer, a lubricant, a nucleating agent, an antistatic agent and a flame retardant.

11. A laminated heating structure according to claim 1, wherein said protective coating layer (C) further comprises at least one additive selected from the group consisting of an inorganic filler, an antioxidizing agent, a heat stabilizer, an ultraviolet absorber, a light stabilizer, a pigment, a dye, a plasticizer, a lubricant, a nucleating agent, an antistatic agent and a flame retardant.

12. A laminated heating structure according to claim 11, wherein the amount of said additive in said protective coating layer (C) is from about 1% to about 90% by weight.

* * * * *